US005221953A

United States Patent [19]

Higaki

[11] Patent Number: 5,221,953

[45] Date of Patent: Jun. 22, 1993

[54] COPYING APPARATUS INCLUDING A SORTER WITH A SHEET BINDING FUNCTION

[75] Inventor: Masahiro Higaki, Toyokawa, Japan

[73] Assignee: Minolta Camera Kabushiki Kaisha, Osaka, Japan

[21] Appl. No.: 711,640

[22] Filed: Jun. 6, 1991

[30] Foreign Application Priority Data

Jun. 9, 1990 [JP] Japan ..... 2-150863
Jun. 9, 1990 [JP] Japan ..... 2-150864
Jun. 14, 1990 [JP] Japan ..... 2-156894

[51] Int. Cl.[5] ..... G03G 21/00
[52] U.S. Cl. ..... 355/324; 271/287
[58] Field of Search ..... 355/308, 309, 311, 208, 355/324; 271/278, 279, 287, 288, 290, 297

[56] References Cited

U.S. PATENT DOCUMENTS 4,361,393 11/1982 Noto ..... 355/323
4,523,750 6/1985 Hubler ..... 270/53
4,864,350 9/1989 Ishiguro et al. ..... 355/311

FOREIGN PATENT DOCUMENTS 0109449 5/1988 Japan ..... 355/324

*Primary Examiner*—Leo P. Picard
*Assistant Examiner*—Christopher Horgan
*Attorney, Agent, or Firm*—Burns, Doane, Swecker & Mathis

[57] ABSTRACT

A copying apparatus with a sorter having a plurality of bins and a stapler for stapling sheets distributed to each of the bins. The stapler has a sensor for detecting staples. The stapler is moved along the bins and stopped at a side of each bin to staple the sheets stored in the bin. When the sensor detects no staples in the stapler, the position of the stapler is stored in a memory, and then the stapler is returned to a home position. After the stapler is loaded with staples, the stapler is moved to the position stored in the memory. The sorter has a counter for counting staples in the stapler, and a count value of the counter is compared with the number of copy sets to be made. When the number of copy sets is larger than the count value, an alarm is raised. Further, the copying apparatus has an automatic document feeder for feeding originals to an exposure position one by one, and the automatic document feeder counts the originals before copying. The stapler is moved to a bin which will receive a first made copy of a last original, which depends on the number of originals, before stapling.

19 Claims, 19 Drawing Sheets

COPYING APPARATUS INCLUDING A SORTER WITH A SHEET BINDING FUNCTION

BACKGROUND OF THE INVENTION

1. Field of the Invention

The present invention relates to an image forming apparatus and more particularly to an image forming apparatus comprising an image forming machine, such as an electrophotographic machine and a laser printer, and a sorter with a sheet binding function.

2. Description of Related Art

In the art of copying machine and printer for forming images on sheets, there have been developed various sorters with automatic staplers. Generally, a cartridge method is adopted in loading such automatic staplers with binding elements (staples). A sensor for detecting staples is provided in such an automatic stapler, and when the sensor detects that the number of staples in the stapler becomes less than a certain number, the apparatus is controlled so as to indicate emptiness of the stapler, to stop the operation and to instruct loading of staples. This type of apparatus is disclosed in U.S. Pat. No. 4,864,350.

However, in a sorter where a stapler moves within a case intermittently along bins so as to staple sheets distributed to each bin, emptiness of the stapler during a stapling operation causes the following problems. When the stapler stops in the middle of the case, loading of staples is difficult. In order to comply with this situation, the case must be openable entirely and must be mechanically strong, which is expensive. With a conventional sorter, an operator cannot recognize the number of remaining staples, and when the operator designates a number larger than the number of remaining staples as the number of copy sets, the operation will be discontinued.

In the art of sorter with a sheet binding function, speedy sheet distribution and speedy sheet binding are most demanded. Accordingly, a reciprocating sorting method is adopted in distributing sheets among bins. Specifically, distribution of copies of a first original begins with a bin at an end and proceeds toward a bin at the other end, and distribution of copies of a next original reverses the bins. However, there have been no techniques to speed up sheet binding.

SUMMARY OF THE INVENTION

An object of the present invention is to provide an image forming apparatus with a sorter which is loaded with binding elements easily.

Another object of the present invention is to provide an image forming apparatus with a sorter which resumes a binding operation smoothly after loading of binding elements.

Another object of the present invention is to provide an image forming apparatus wherein there occur no problems even if a binding operation is discontinued because of lack of binding elements.

A further object of the present invention is to provide an image forming apparatus which can perform speedy sheet binding in accordance with speedy sheet distribution adopting the reciprocating sorting method so as to increase its production.

In order to attain the object above, an image forming apparatus according to the present invention comprises means for forming an image on a sheet; means for distributing sheets which have received images among a plurality of bins; means for binding the sheets distributed to each of the bins, the binding means containing a number of binding elements; means for moving the binding means along the bins and for stopping the binding means at a specified position; means for detecting the binding elements in the binding means; and control means for, when the binding element detecting means detects no binding elements, moving the binding means to a position where the binding means is loaded with binding elements.

In the apparatus above, sheets ejected from the image forming means are distributed among the bins in order. Then, binding is started if necessary. More specifically, the binding means is moved step by step so that the binding means faces each of the bins and that the binding means binds the sheets distributed to each of the bins. When the binding means is emptied of binding elements during the binding, the binding means is immediately moved to the position where the binding means is loaded with binding elements, as an example, the topmost of the moving range of the binding means (home position), which is convenient for the loading.

Preferably, the image forming apparatus of the present invention further comprises memory means for memorizing which bin the binding means faces when the binding element detecting means detects no binding elements; and means for detecting completion of loading of the binding means with binding elements. In the apparatus, when the loading detecting means detects the completion of loading, the control means moves the binding means to the bin memorized by the memory means.

Another image forming apparatus of the present invention comprises means for counting binding elements in the binding means; and means for indicating the number of binding elements counted by the counting means. In a type where the binding means is loaded with a specified number of binding elements (cartridge type), the specified number is stored in a counter of the control system when a new cartridge is loaded, and each time the binding means consumes one binding element, the count value is reduced by one.

The image forming apparatus further comprises mean for designating the number of imaged-sheet sets to be made by the image forming means; means for comparing the number of imaged-sheet sets designated by the designating means with the number of binding elements counted by the counting means; and means for, when the comparing means judges that the designated number of imaged-sheet sets is larger than the number of binding elements, giving an indication. The indication, as an example, is flickering of a lamp on an operation panel.

Another image forming apparatus of the present invention comprises means for feeding originals to an exposure position one by one; means for counting the originals fed by the original feeding means; means for reciprocating the binding means along the bins and for stopping the binding means at a specified position; and control means for designating one of the bins as a binding start bin which is first subjected to sheet binding in accordance with the number of originals counted by the counting means, and for moving the binding means to the designated bin. More specifically, when the number of the originals is an odd number, the control means designates a first bin which is to receive a first made copy of a first fed original as the binding start bin and moves the binding means to the first bin, and when the number of the originals is an even number, the control means designates a bin which is to receive a last made copy of the first fed original as the binding start bin and moves the binding means to the bin. Further, in a type where the bins are laterally postured and arranged one upon another, when the number of the originals is an odd number, the top bin is designated as the binding start bin, and when the number of the originals is an even number, a bin of a number from the top same as the number of copy sets is designated as the binding start bin. Preferably, the control means moves the binding means to the designated binding start bin before a last made copy of a last fed original is distributed to a specified one of the bins.

In the apparatus, as soon as a first made copy of a last fed original has been distributed to a bin, the sheet binding can be started even while the rest of the copies are being distributed to other bins. Thereby the apparatus is improved in copying speed and accordingly improved in production.

BRIEF DESCRIPTION OF THE DRAWINGS

These and other objects and features of the present invention will become apparent from the following description taken in conjunction with the preferred embodiments thereof with reference to the accompanying drawings, in which:

FIG. 1 is a view showing the general constitution of the apparatus including a copying machine and a sorter;

FIG. 2 is a view showing the internal composition of the sorter;

FIG. 3 is a front view showing a distribution section which is an essential part of the sorter;

FIG. 4 is a plan view showing a bin provided with sheet aligning means and sheet pushing means;

FIG. 5 is a perspective view showing the bin and the sheet pushing means;

FIG. 6 is a side view showing bins, a stapler and stapler moving means;

FIG. 7 is a cross sectional view showing the stapler;

FIG. 8 is a plan view showing a sorter panel;

FIG. 9 is a block diagram showing a control circuitry;

FIG. 10 is a flowchart showing a main routine of a microcomputer controlling the sorter;

FIG. 11 is a flowchart showing a subroutine for counting staples;

FIG. 12 is a flowchart showing a subroutine for controlling the stapler;

FIG. 13 is a flowchart of a subroutine for performing stapling;

FIG. 14 is a flowchart of a subroutine for performing preliminary processing preparatory to movements of the stapler for loading of staples and after the loading of staples;

FIG. 15 is a flowchart of a subroutine for moving up the stapler for loading of staples;

FIG. 16 is a flowchart of a subroutine for moving down the stapler after the loading of staples;

FIG. 17 is a flowchart of a subroutine for raising an alarm;

FIG. 18 is a flowchart of a subroutine for counting original documents performed by a microcomputer controlling the copying machine;

FIG. 19 is a flowchart showing a main routine of a microcomputer controlling the sorter;

FIG. 20 is a flowchart showing a subroutine for controlling the stapler;

FIG. 21 is a flowchart showing a subroutine for designating a stapling start bin where the stapler starts stapling;

FIG. 22 is a flowchart showing a subroutine for moving the stapler to the designated bin before stapling; and FIG. 23 is a time chart showing timing of sorting and stapling.

DETAILED DESCRIPTION OF THE PREFERRED EMBODIMENTS

The following describes exemplary image forming apparatuses embodying the objects and features of the present invention, referring to the accompanying drawings.

First Embodiment: FIGS. 1–17

General Constitution

Figure 1:
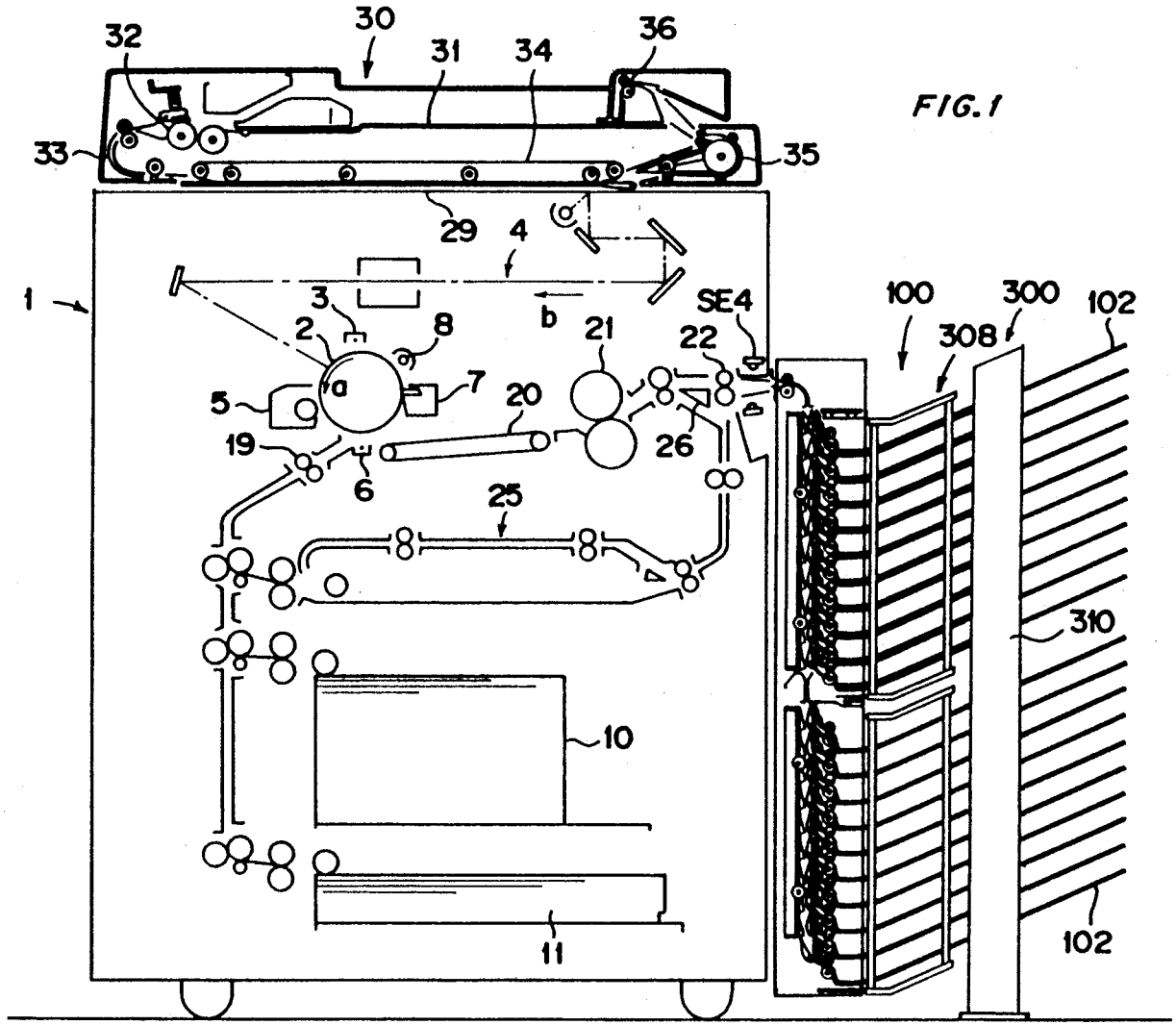
FIGS. 1 through 17 show a first exemplary image forming apparatus according to the present invention.

Referring to FIG. 1, an image forming apparatus of a first embodiment comprises a copying machine 1, a sorter 100 and a recirculating type document handling machine 30 (hereinafter referred to as RDH).

The copying machine 1 forms an image on a sheet in a well-known electrophotographic method. First, a photosensitive drum 2 driven to rotate in a direction indicated by arrow a is electrically charged by an electric charger 3. While an optical system 4 is moving in a direction indicated by arrow b, an original document placed on an original supporting glass 29 is subjected to slit exposure. Thereby an electrostatic latent image is formed on the photosensitive drum 2, and the latent image is developed into a toner image by a developing device 5 adopting a magnetic brush method. Then, the toner image is transferred onto a sheet while a transfer charger 6 provides the sheet with electrostatic.

Copy sheets are fed form an elevate type automatic paper feeder 10 or a cassette type automatic paper feeder 11 one by one. The copy sheets are supplied to the transfer section by a timing roller 19 at specified intervals. A copy sheet which has received an image is fed to a fixing device 21 through a conveyor belt 20, where the toner image is fixed on he sheet. Then, the copy sheet is fed to the sorter 100 by ejection rollers 22, and at that time, a photosensor SE4 detects the copy sheet. A refeeding device 25 used for duplex copying and composite copying is provided in the copying machine 1, and a diverting pawl 26 is disposed so as to divert the travel of copy sheets toward the refeeding device 25.

The photosensitive drum 2 continues rotating in the direction of arrow a even after the transference of the toner image onto the sheet so that a cleaning device 7 with a blade removes residual toner from the photosensitive drum 2 and an eraser lamp 8 erases residual charge on the photosensitive drum 2. Thus, the photosensitive drum 2 gets ready for next copying.

The RDH 30 is of a conventional type. A feed roller 32 feeds original documents placed on an original tray 31 one by one, and each original document passes through a reversing section 33 and is put in a specified place on the original supporting glass 29 with rotation of a conveyor belt 34. After exposure, the original document is fed back onto the original tray 31 via a reversing section 35 and ejection rollers 36 with rotation of the conveyor belt 34.

Sorter Unit

Figure 2:
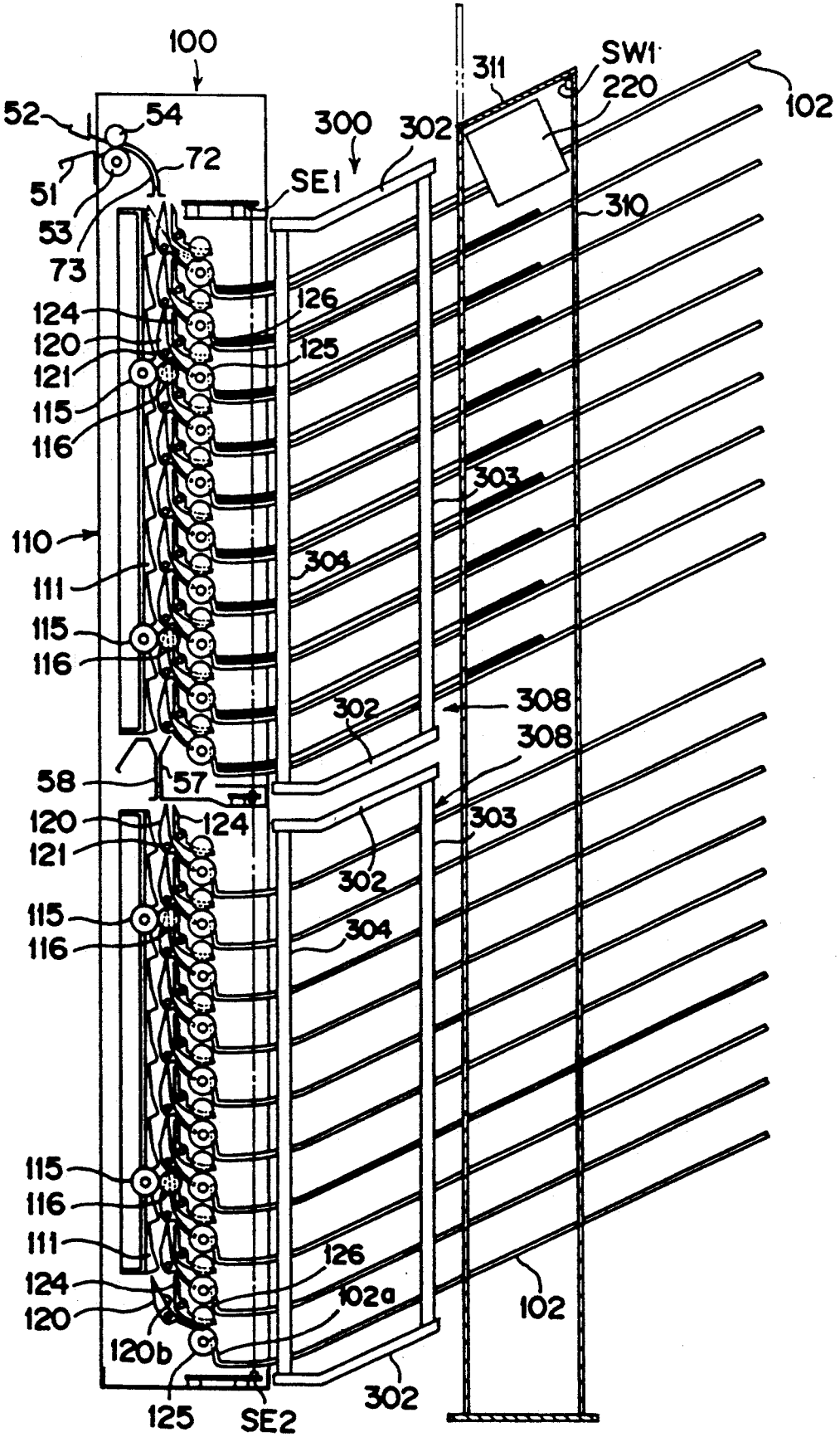
Figure 3:
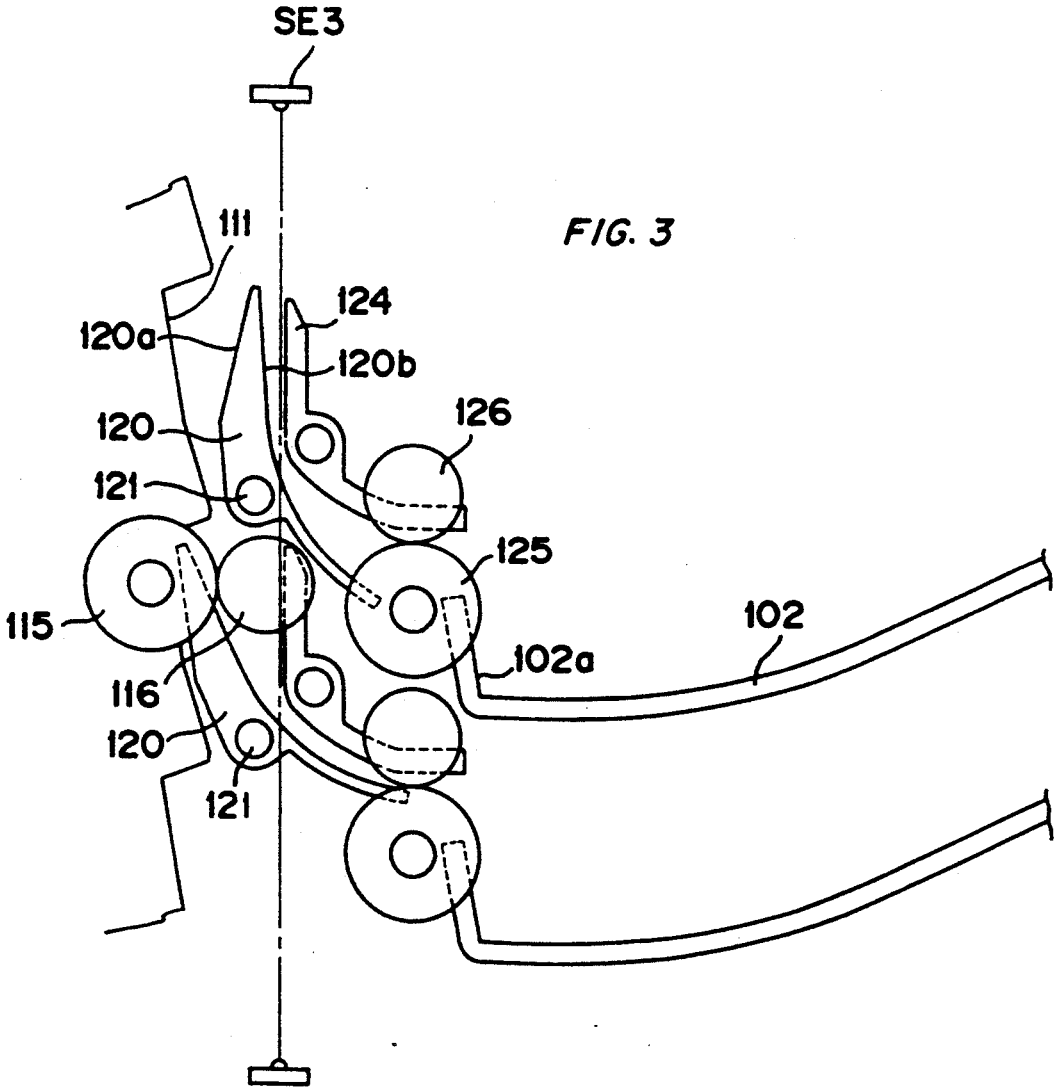

Referring to FIG. 2, the sorter 100 comprises 20 bins 102 among which copies are distributed, a vertical path 110, diverting pawls 120, and ejection rollers 125 and 126 disposed at the entrances of the bins 102. The sorter 100 is divided into an upper section including 10 upper bins and a lower section including 10 lower bins. The sorter 100 also includes a finisher unit 300 for stapling sheets.

The vertical path 110 comprises vertical guide frames 111, four transport rollers 115, four pinch rollers 116 which are pressed against the transport rollers 115 and which rotate following the transport rollers 115, the diverting pawls 120 and guide plates 124 disposed at the entrances of the bins 102, the ejection rollers 125 and pinch rollers 126 which are pressed against the ejection rollers 125 and which rotate following the ejection rollers 125. The upper section and the lower section are connected by guide plates 57 and 58. At the entrance of the sorter 100 are guide plates 51 and 52, receiving rollers 53 and 54, guide plates 72 and 73 for guiding copy sheets into the vertical path 110. Transmitting type photosensors SE1 and SE2 are provided so as to detect sheets in the bins 102 of the upper section and in the bins 102 of the lower sections respectively. Also a photosensor SE3 is provided so as to detect a sheet entering any one of the bins 102 (see FIG. 3).

Every of the diverting pawls 120 except for the one at the entrance of the bottom bin is driven by its exclusive solenoid so as to pivot on a shaft 121. When the solenoid is off, the diverting pawl 120 is in a position as indicated by the solid line in FIG. 2 so that a sheet is guided downward by the vertical guide frame 111 and a vertical surface 120*a* of the diverting pawl 120 (see FIG. 3). The transport rollers 115 and 116 provide the sheet with downward force. When the solenoid is turned on, the diverting pawl 120 is set as the top bin indicated by the dashed line in FIG. 2 so that a sheet is guided toward the bin 102 by a curved surface 120*b* of the diverting pawl 120 and the guide plate 124. The ejection rollers 125 and 126 transport the sheet into the bin 102 at that time. The switching of the diverting pawl 120 is performed in response to detection of the trailing edge of a sheet by the sensor SE3. By switching the diverting pawls 120 in order from the top, sheets are distributed among a number of bins 102 same as the number of copy sets from the top. Further, in a grouping mode, where copies of an original are stored in the same bin 102, the diverting pawls 120 are switched in response to the arrival of the last copy of an original in the bin 102. The diverting pawl 120 at the entrance of the bottom bin 102 is not pivotable and is fixed in a position to guide a sheet into the bin 102.

Finisher Unit

Figure 4:
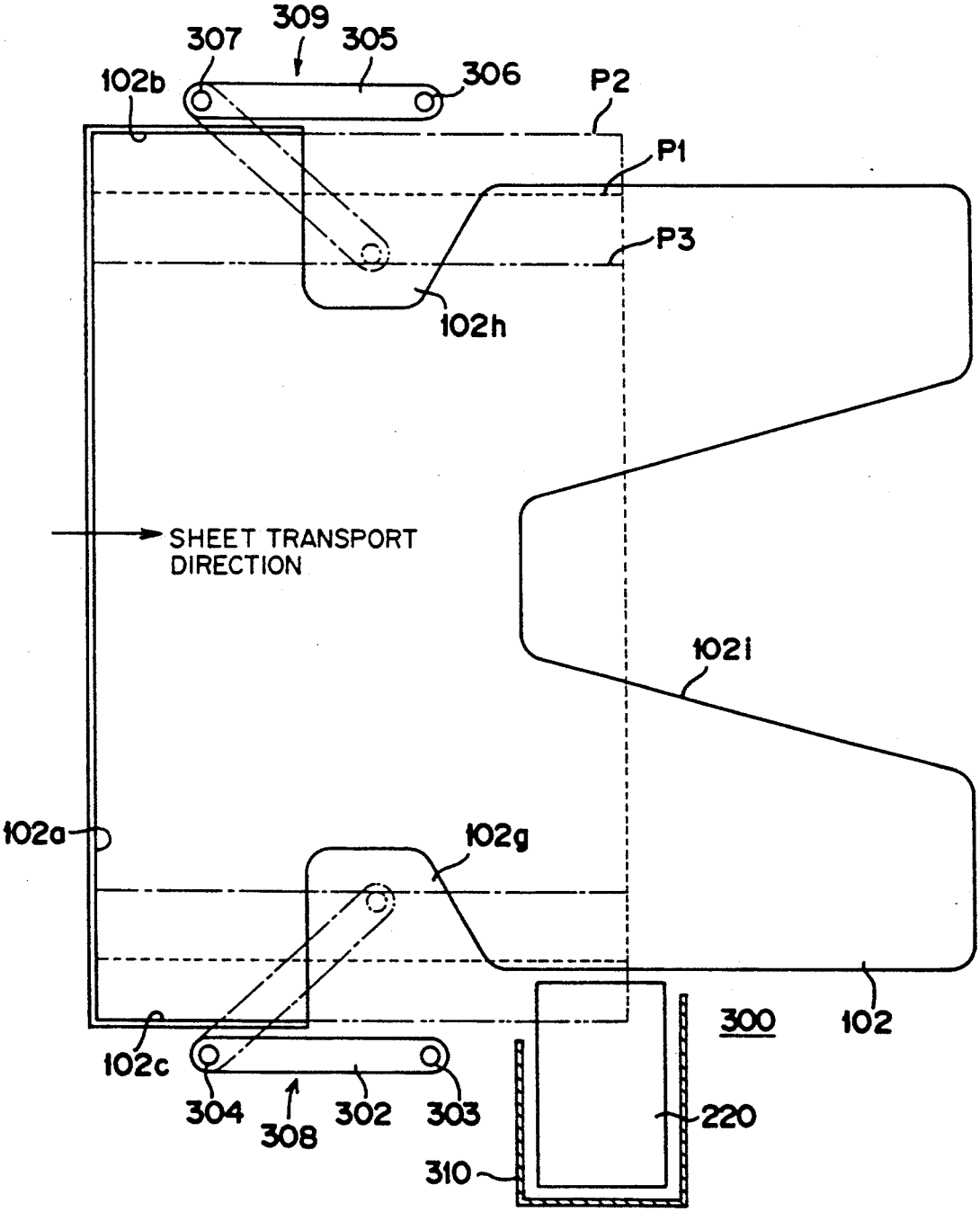

Referring to FIGS. 2 and 4, the finisher unit 300 comprises a stapler 220 in the front, aligning means 308 for pushing a sheet transported into each of the bins 102 against an alignment reference plate 102*b* in the rear, pushing means 309 for pushing sheets stored in each of the bins 102 against a stapling reference plate 102*c* which regulates the sheets in a position to be engaged with the stapler 22, and moving means 400 (see FIG. 6) for moving the pushing means 309 and the stapler 220 to each of the bins 102. The bins 102 incline in respect to the direction where sheets enter the bins 102, and the bins 102 are arranged one upon another at uniform intervals. The alignment reference plate 102*b* and the stapling reference plate 102*c* are attached to every one of the bins 102. Each of the bins 102 has a reversion prevention plate 102*a* for stopping the trailing edge of a sheet transported into the bin 102. Each of the bins 102 is also provided with notches 102*g* and 102*h* in which the aligning means 308 and the pushing means 309 can come respectively, and a notch 102*i* which facilitates an operator's taking sheets out of the bin 102.

The aligning means 308, as shown in FIGS. 2 and 4, comprises levers 302, an alignment stick 303 and a shaft 304 which are laid between the levers 302 at either end. The levers 302 are capable of pivoting laterally on the shaft 304. The upper bin section and the lower bin section are provided with the aligning means 308 each, and the aligning means 308 are driven by separate driving means such as solenoids and stepping motors (not shown).

Alignment is performed toward every sheet transported into the bins 102. Specifically, every time a sheet Is transported into one of the bins 102, the aligning means 308 pivots on the shaft 304 and comes into a position indicated by the dashed line in FIG. 4. Then, the alignment stick 303 pushes the sheet against the alignment reference plate 102*b* so as to regulate the sheet between the stick 303 and the plate 102*b*. Thus, a sheet transported to a position P1 indicated by the dotted line in FIG. 4 is put in a position P2 indicated by the dashed line. Also, since the bin 102 inclines, the sheet reverses, and the reversion is stopped by the reversion prevention plate 102*a*. Thus, every sheet transported into any one of the bins 102 is automatically aligned in respect to the sheet transport direction.

Figure 5:
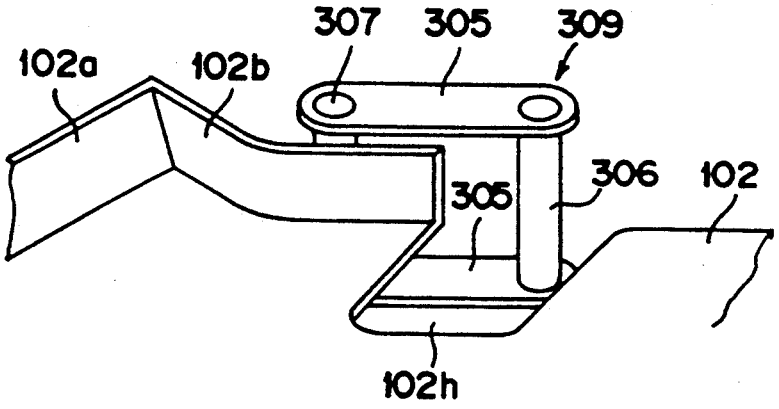

The pushing means 309, as shown in FIGS. 4 and 5, comprises levers 305, a pushing stick 306 and a shaft 307 which are laid between the levers 305 at either end. The levers 305 are capable of pivoting laterally on the shaft 307, and they are driven by a solenoid, a stepping motor or the like (not shown). The pushing means 309 is movable within a range from the top bin 102 to the bottom bin 102, and its movement is synchronized with movement of the stapler 220 by the moving means 400 as will be described later. After completion of sheet sorting, the pushing means 309 pushes sheets out of each bin 102. More specifically, the pushing means 309, together with the stapler 220, is moved to a bin 102 which is to be subjected to sheet stapling, and the levers 305 pivot on the shaft 307 to come in a position indicated by the dashed line in FIG. 4. Then, the pushing stick 306 pushes the sheets against the stapling reference plate 102*c*. Thus, the sheets are shifted from the alignment position P2 indicated by the dashed line to a stapling position P3 indicated by the two-dot chain line, where the sheets are engaged with the stapler 220. In this state the stapler 220 operates to staple the sheets. Thereafter the aligning means 308 operates so that the aligning stick 303 pushes the stapled sheets against the alignment reference plate 102*b*. Thus, the stapled sheets are returned to the alignment position P2 from the stapling position P3, and the stapled sheets separate from the stapler 220. Then, the pushing means 309 and the stapler 220 are moved to a next bin 102.

Stapler and Moving Means

Figure 7:
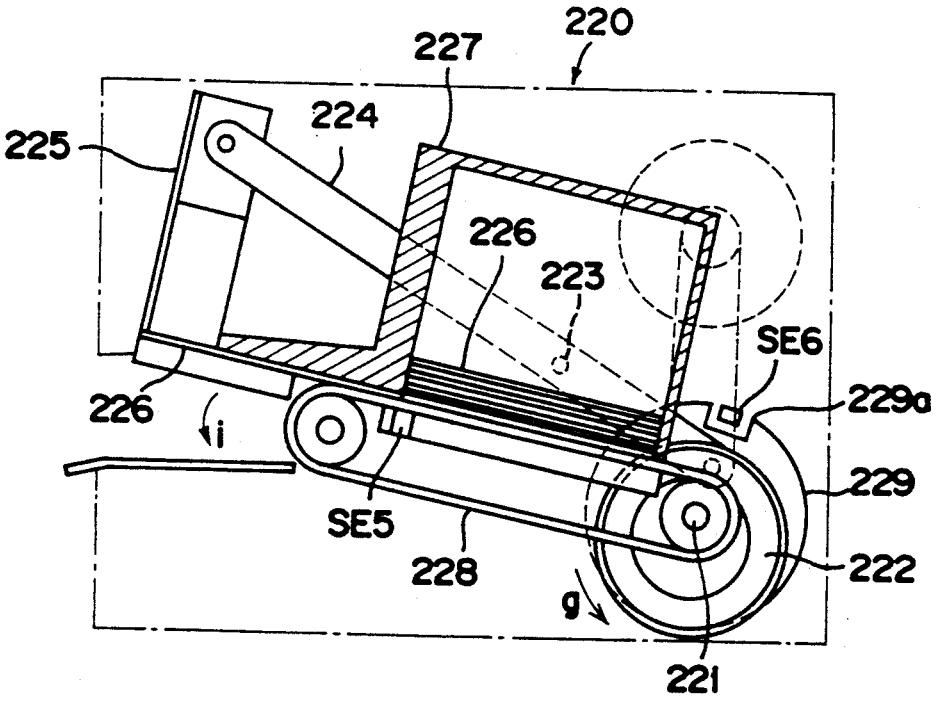

Referring to FIG. 7, the stapler 220 comprises a cam 222 fitted on a motor output shaft 221, a head 225, and an arm 224 connecting the cam 222 and the head 225. An end of the arm 224 is in contact with the circumference of the cam 222, and the arm 224 pivots on a pin 223. As the cam 222 is rotating in a direction indicated by arrow g with rotation of the motor, the arm 224 pivots downward and the head 225 moves in a direction indicated by arrow i. Thus, sheets aligned in one of the bins 102 are bound with a staple 226. A plate-like block of straight staples 226, which are joined together by adhesive, is used in the stapler 220. A specified number of staples 226 are in a cartridge 227, and the staples 226 are pressed downward by a spring member (not shown). The staples 226 in the cartridge 227 are supplied to the head 225 one by one from the bottom through a conveyer belt 228. A reflective type photosensor SE5 is provided in the stapler 220 so as to detect the staples 226 in the cartridge 227. When the last staple 226 passes the photosensor SE5, the sensor SE5 is turned off and detects non-presence of staples 226 in the cartridge 227. The photosensor SE5 also detects whether the cartridge 227 is mounted on the stapler 220. The photosensor SE5 is kept on while the cartridge 227 is mounted on the stapler 220, and the photosensor SE5 is turned off when the cartridge 227 is dismounted from the stapler 220. The stapler 220 further has a photosensor SE6 for detecting rotation frequency of the stapling motor. The sensor SE6 senses a notch 229*a* of a disk 229 fitted on the motor output shaft 221.

Figure 6:
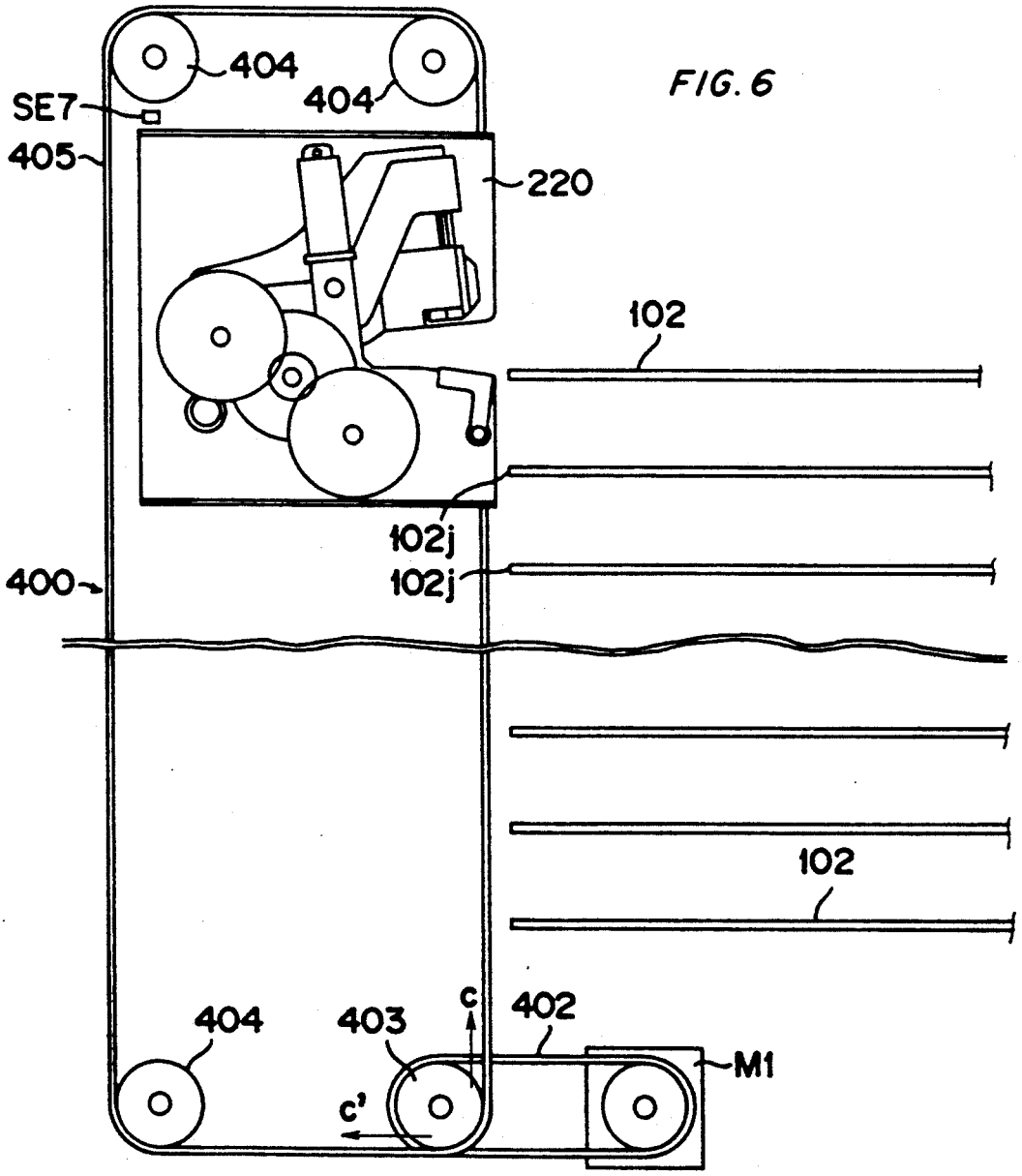

The stapler 220 is in a case 310 disposed vertically in front of the bins 102, and moves up and down within the case 310. The case 310 has an openable cover 311 on the top. The cover 311 is opened for a cartridge change, and a switch SW1 detects whether the cover 311 is open or closed. The stapler 220 in the case 310, as shown in FIG. 6, is fitted on an endless belt 405 stretched around rollers 403 and 404. The roller 403 is connected with a stepping motor M1 by a belt 402 so that rotation of the motor M1 is transmitted to the roller 403. Thus, the belt 405 is moved in a direction of arrow c or arrow c' with rotation of the roller 403. The stapler 220 is moved up or down in accordance with movement of the belt 405 in a direction of c or c' and is put in a specified position. The pushing means 309 is moved in synchronization with the stapler 220 by transmitting means (not shown).

At the start of stapling, the stapler 220 is in a home position alongside the top bin 102. A photosensor SE7 detects the stapler 220 in the home position. The stapling proceeds as the stapler 220 is moving down step by step, each step corresponding to the interval among the bins 102. Thus the stapler 220 staples sheets stored in each of the bins 102. The travel of the stapler 220 is detected and controlled by counting pulses driving the stepping motor M1.

The cartridge 227 initially contains 5,000 staples. When a new cartridge 227 is mounted on the stapler 220, an indicator 365 of an operation panel 350 (see FIG. 8) indicates "5000". Then, as the staples 226 in the cartridge 227 are being used one by one, the indicated number becomes smaller. In a mode of stapling sheets, a number designated as the number of copy sets is compared with the number of staples 226 remaining in the cartridge 227 before starting the operation. When the designated number is larger than the number of remaining staples 226, an alarm is raised.

When the sensor SE5 detects non presence of staples in the cartridge 227 during stapling, the stapling is discontinued, and the number of pulses driving the motor M1 is stored in a memory as the position of the stapler 220. Then, the stapler 220 is returned to the home position, and the operator opens the cover 331 to change cartridges. Completion of the cartridge change is recognized by a turning-on of the sensor SE5 and a turning-on of the switch SW1. The stapler 220 is moved down by an amount corresponding to the number of pulses stored in the memory, and the stapling is resumed.

The control will be described later referring to flowcharts.

Operation Panel

Figure 8:
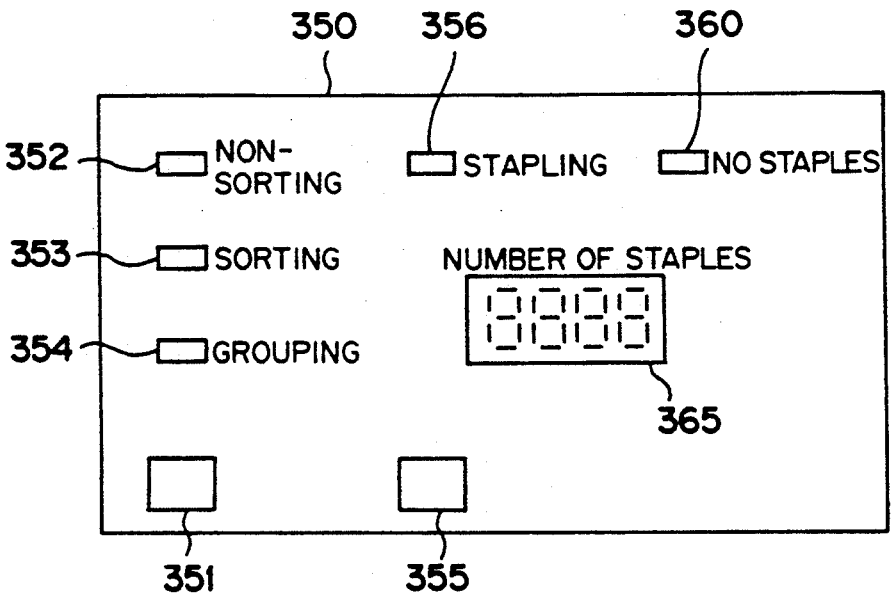

Referring to FIG. 8, the operation panel 350 of the sorter 100 comprises an operation mode selection key 351, LEDs 352, 353 and 354 for indicating a non-sorting mode, a sorting mode and a grouping mode respectively, a stapling mode selection key 355, an LED 356 for indicating a stapling mode, an LED 360 for indicating non-presence of staples 226 in the stapler 220, and the seven-segment indicator 365 for indicating the number of staples 226 in the stapler 220.

Every time the operation mode selection key 351 is pressed, the mode selection becomes the non-sorting mode, the sorting mode and the grouping mode in order and accordingly the LEDs 352, 353 and 354 are lit. When the stapling mode selection key 355 is pressed, the stapling mode is selected and canceled alternately and accordingly the LED 356 is lit and extinguished. The LED 360 is lit when the sensor SE5 in the stapler 220 detects no staples, and is extinguished when a new cartridge 227 is mounted on the stapler 220. The LED 365 flickers when the number of copy sets is larger than the number of staples 226 in the stapler 220 so as to give an alarm to the operator.

Control Circuitry

Figure 9:
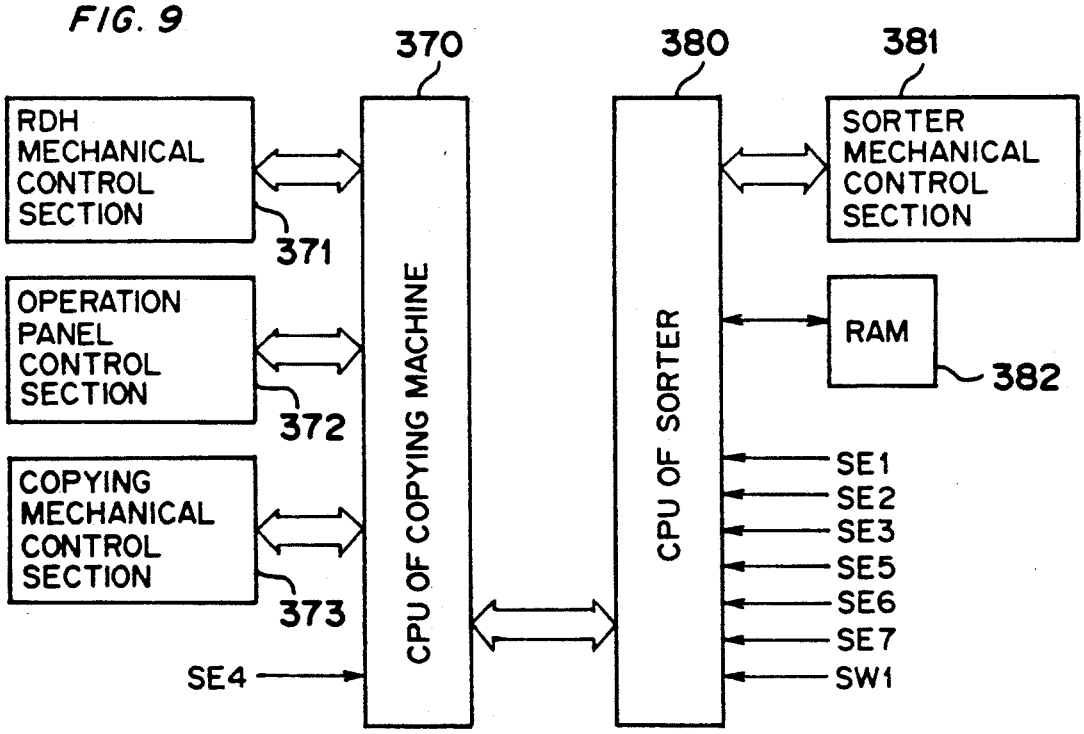

FIG. 9 is a block diagram of a control circuitry. The main elements of the control circuitry are a microcomputer (CPU) 370 controlling the copying machine 1 and a microcomputer (CPU) 380 controlling the sorter 100, and the CPUs 370 and 380 are connected by a bus. Connected with the CPU 370 are a mechanical control section 371 of the RDH 30, a control section 372 of an operation panel, a mechanical control section 373 for copying, the detecting means like the copying machine ejection sensor SE4, etc. Connected with the CPU 380 are a mechanical control section 381 of the sorter 100, the detecting means like the sensor SE1 and the switch SW1, etc. The CPU 380 has a built-in random access memory (RAM) 382.

Control Procedure

The following describes a control procedure performed by the control circuitry, referring to FIGS. 10 through 17. In the following description, the term "on-edge" means the state of a switch, a sensor or a signal at the moment of changing from off to on, and the term "off-edge" means the state of a switch, a sensor or a signal at the moment of changing from on to off.

Figure 10:
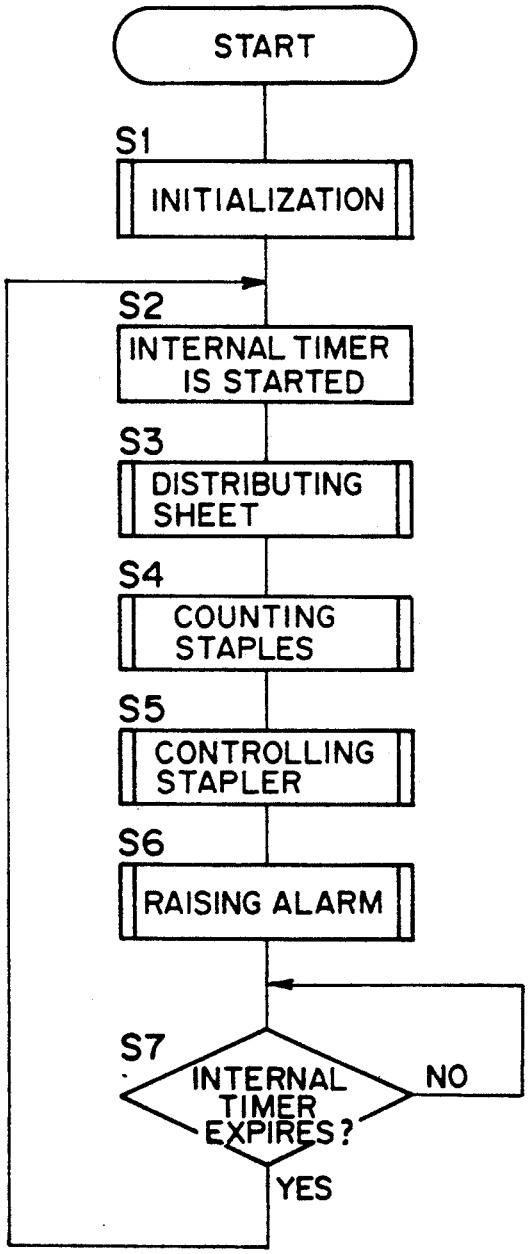

FIG. 10 shows a main routine of the CPU 380.

When the CPU 380 is reset and the program starts, at step S1 the RAM 382 is cleared and all the registers and devices are initialized. Next, an internal timer is started at step S2. The internal timer is to determine a time required for one cycle of the main routine, and the value of the timer is set at the initialization step S1.

Subroutines are called at steps S3 through 86. Then, expiration of the internal timer is confirmed at step S7, and the processing returns to step S2. Values of timers used in the subroutines are based on the time for one cycle of the main routine.

A subroutine called at step S3 is to control sheet distribution among the bins 102, and the description of the procedure is omitted here. A subroutine called at step 84 is to control count of staples 226 remaining in the stapler 220. A subroutine called at step S5 is to control sheet stapling with the stapler 220 and reaction to the stapler 220 being empty of staples 226. A subroutine called at step S6 is to control comparison of the number of remaining staples 226 with a designated number as the number of copy sets by the operator. The subroutines at steps S4, S5 and S6 will be described later.

Figure 11:
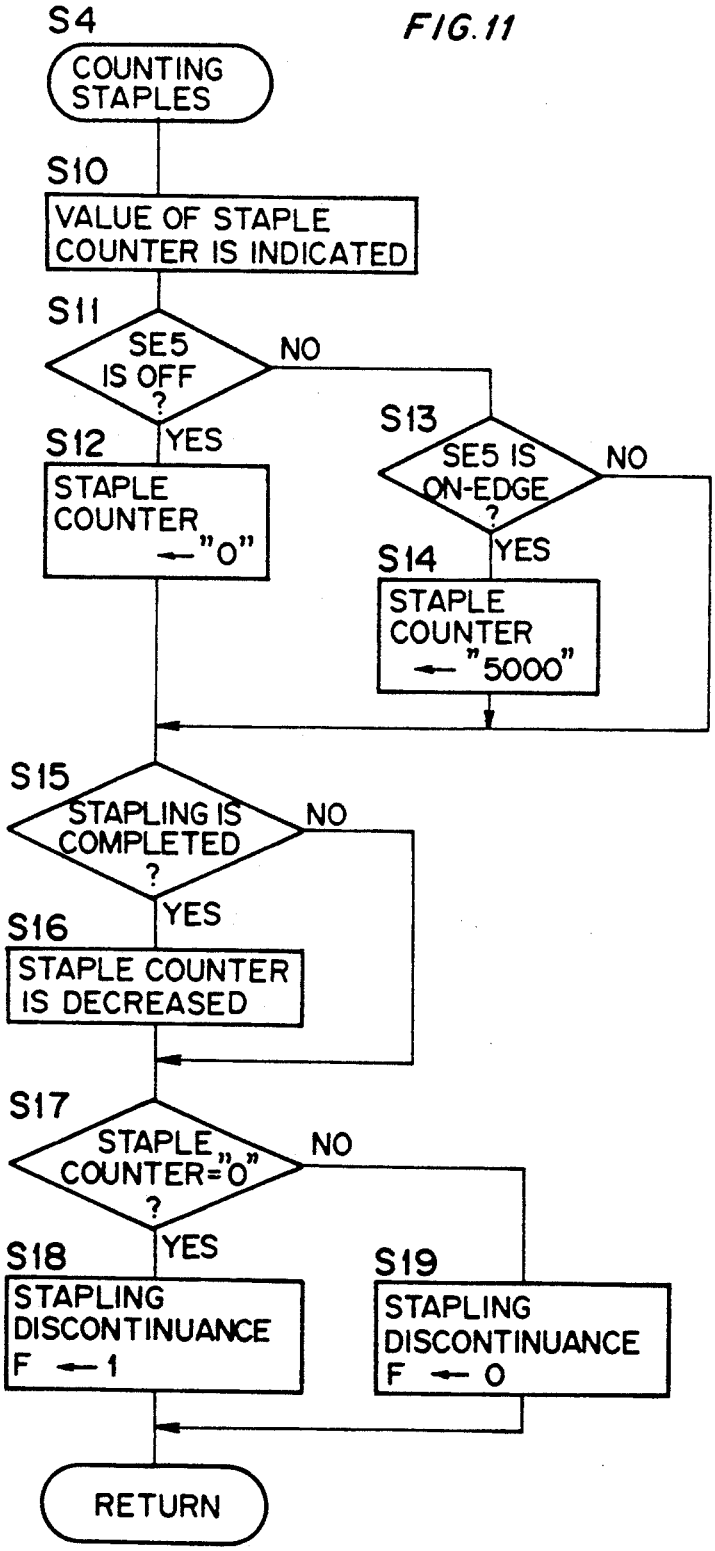

FIG. 11 shows the staple counting subroutine carried out at step S4.

First, the value of a staple counter (the number of staples 226 in the stapler 220) in the RAM 382 is indicated on the indicator 365 at step S10, and the sensor SE5 is checked at step S11 so as to judge whether the cartridge 227 is mounted on the stapler 220. When the sensor SE5 is off, which means that the cartridge 227 has been dismounted from the stapler 220, the staple counter is reset to "0" at step S12. Then, the processing goes to step S15. When the sensor SE5 is on, the sensor SE5 is checked at step S13 whether it is on-edge. When the sensor SE5 is on-edge, which means that a new cartridge 227 is mounted on the stapler 220, the staple counter is set to "5,000" at step S14. Then, the processing goes to step S15. When the sensor SE5 is not judged to be on-edge at step S13, the processing proceeds to step 815 directly.

It is judged at step S15 whether stapling sheets stored in one of the bins 102 is completed. On the completion of the stapling, the count value of the staple counter is decreased by one at step S16. Next, the count value of the staple counter is judged whether to be "0" at step S17. When the count value is "0", a stapling discontinuance flag is set to "1" at step S18. When the count value is not "0", the stapling discontinuance flag is reset to "0" at step S19.

Figure 12:
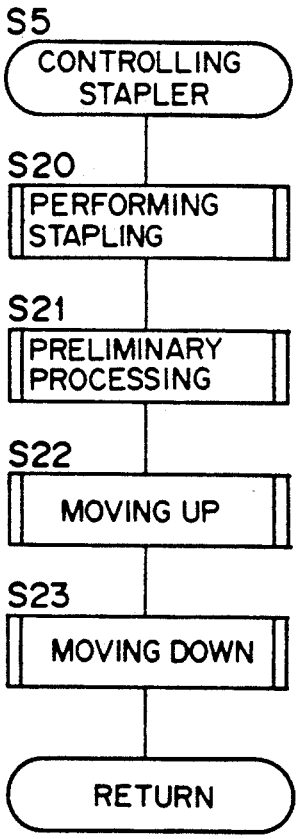

FIG. 12 shows the stapler controlling subroutine carried out at step S5.

At step S20, the stapler 220 is controlled to move down step by step from the home position alongside the top bin so as to staple sheets stored in each of the bins 102. At step S21, when the stapler 220 is emptied of staples, preliminary processing preparatory to movements of the stapler 220 to and from the home position is performed. At steps S22 and S23, the movements of the stapler 220 in response to the emptiness of the stapler 220 are carried out. More specifically, the stapler 220 is returned to the home position for a cartridge change at step S22, and after the cartridge change, the stapler 220 is moved down to a position where it was when it was emptied of staples at step S23.

Figure 13:
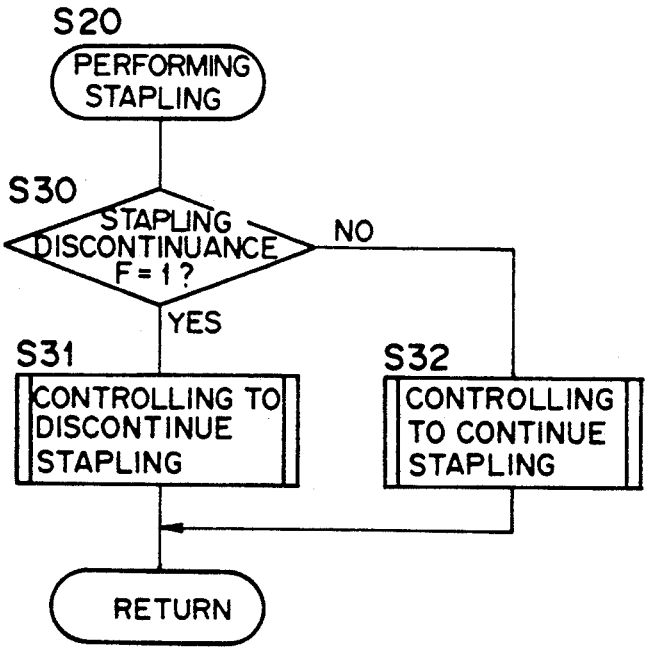

FIG. 13 shows a stapling subroutine carried out at step S20.

First, the stapling discontinuance flag is judged whether to be "1" at step S30. This flag was set to "1" or reset to "0" at step S18 or step S19. When the flag is judged to be "1", the processing goes to step S31 where the stapler 220 is controlled to discontinue stapling. When the flag is judged to be "0", the processing goes to step S32 where the stapler 220 is controlled to continue stapling. Since a process of stapling sheets with the stapler 220 is well-known, the description of the processing at steps S31 and S32 is omitted.

Figure 14:
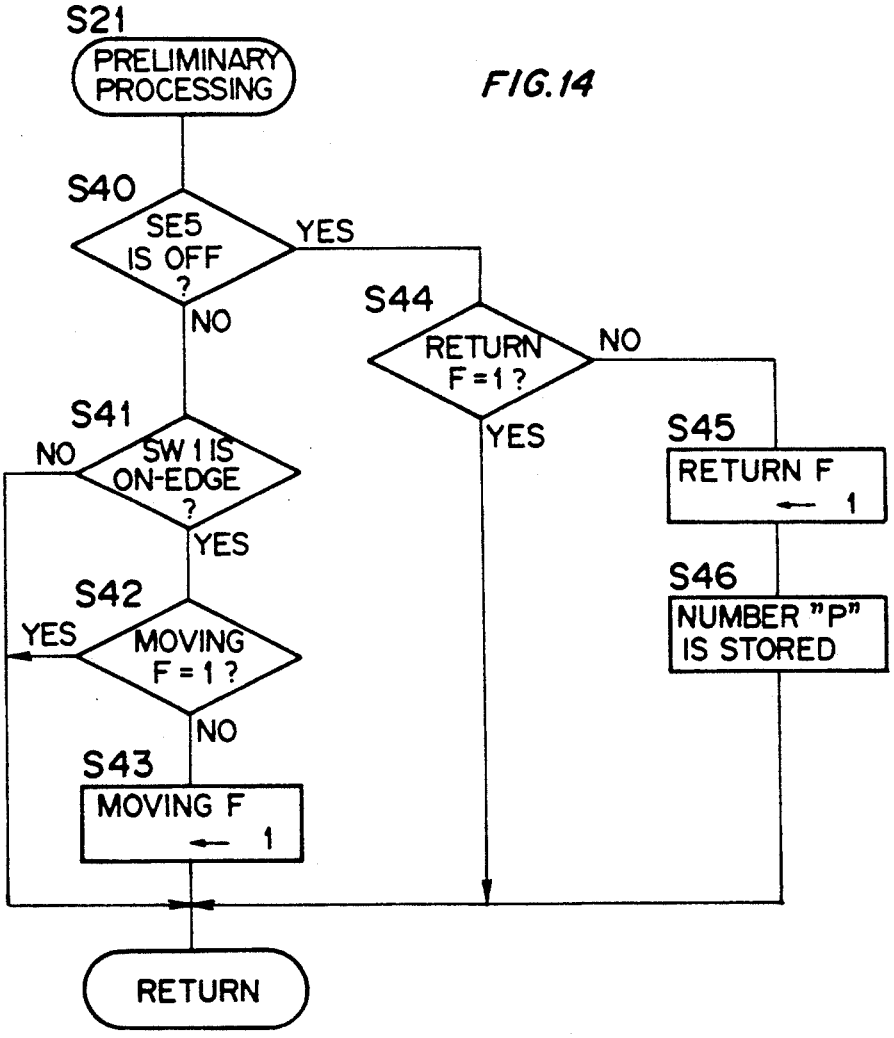

FIGS. 14 shows a subroutine for the preliminary processing carried out at step S21.

The sensor SE5 is checked at step S40 so as to judge the presence of staples 226 in the stapler 220. The switch SW1 is checked at step S41 so as to judge the open or closed state of the case cover 311. A return flag is checked at step S44 so as to judge whether the stapler 220 should be returned to the home position. While there remain staples 226 in the stapler 220, the sensor SE5 is kept on. In this situation, usually the results at steps S40 and S41 are "NO", and the processing returns to the main routine. When the stapler 220 is emptied of staples, the sensor SE5 is turned off, in which situation the result at step S40 is "YES", and the return flag is checked at step S44. When the sensor SE5 is turned off, the stapling is discontinued in the subroutine at step S20 (see steps S11, S18 and S31). That is, the stapler 220 is stopped when the stapler 220 is emptied of staples. When the return flag is judged to be "0" at step S44, the flag is set to "1" at step S45, and at step S46 the number "P" of pulses which drove the stepping motor M1 to move the stapler 220 from the home position to the current position is stored in a bin counter. When the return flag is judged to be "1" at step S44, the processing returns to the main routine.

When the return flag is "1", the processing proceeds to step S22 where the stapler 22 is moved up to the home position. Then, the operator opens the cover 311 to change cartridges. When a new cartridge 227 is mounted on the stapler 220, the sensor SE5 is turned on ("NO" at step 540), and the switch SW1 is checked at step S41 whether it is on-edge. When the cover 311 is closed and the switch SW1 becomes on-edge ("YES" at step S41), a moving flag is checked at step S42. When the moving flag is "0", the flag is set to "1" at step S43. Then, the processing returns to the main routine.

Figure 15:
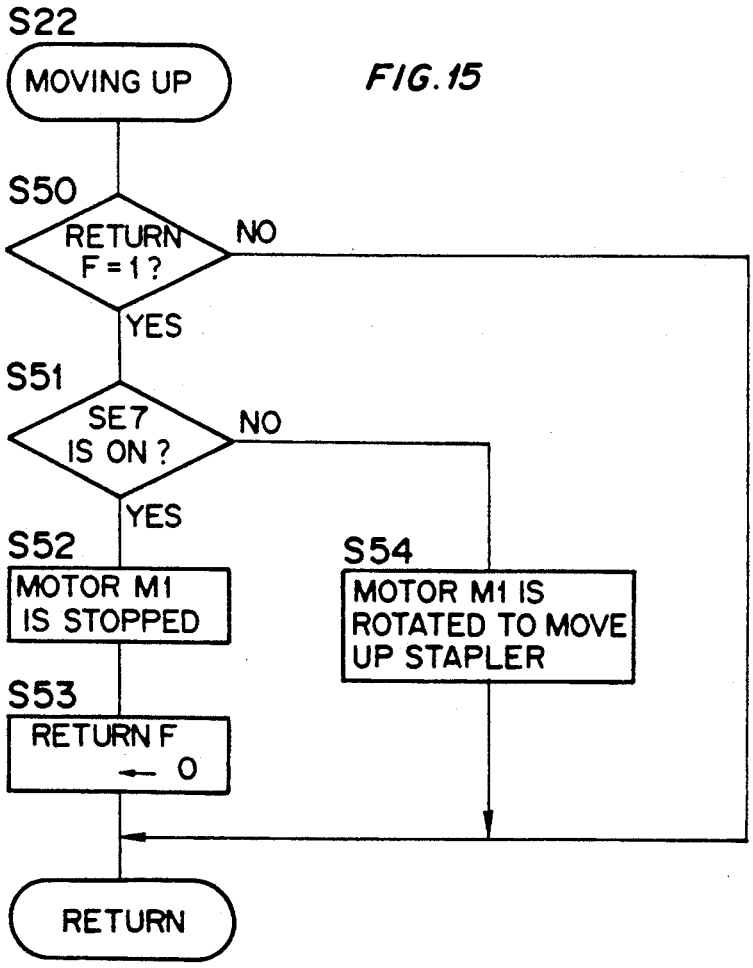

FIG. 15 shows a subroutine for moving the stapler 220 up to the home position, which is carried out at step S2Z.

First, the return flag is checked at step S50. When the flag is "1", the sensor SE7 is checked so as to judge whether the stapler 220 has reached the home position. When the sensor SE7 is off, the stepping motor M1 is rotated to move up the stapler 220 at step S54. When the stapler 220 reaches the home position ("YES" at step S51), the stepping motor M1 is stopped at step S52, and the return flag is reset to "0" at step S53. Then, the processing returns to the main routine. A cartridge change is performed in this state.

Figure 16:
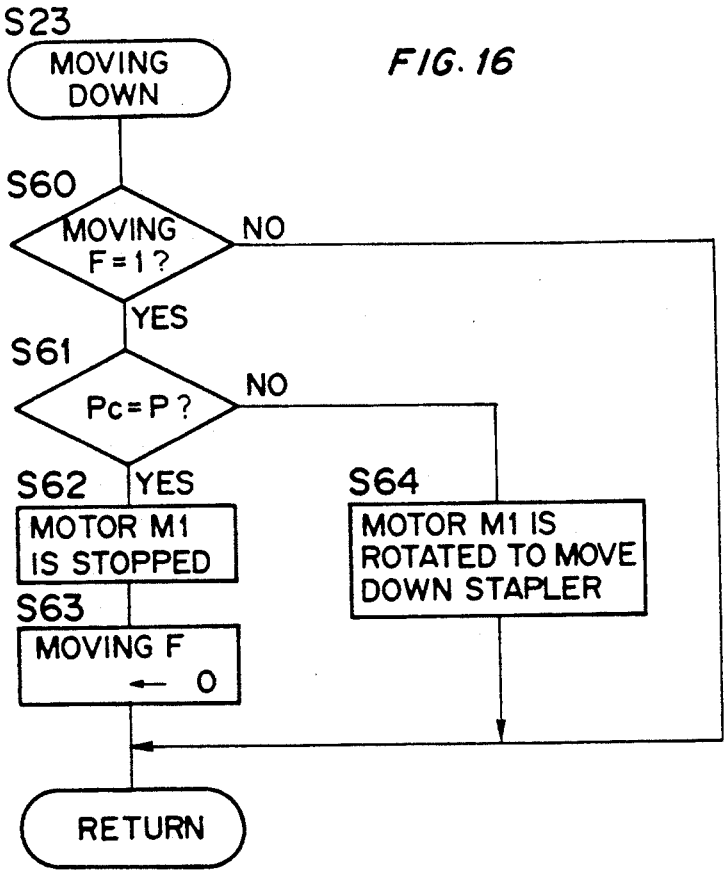

FIG. 16 shows a subroutine for moving the stapler 220 down to the position where the stapling was discontinued, which is carried out at step S23.

First, the moving flag is checked at step S60. When the flag is "1", which indicates completion of a cartridge change, at step S61 the current number "Pc" of pulses driving the stepping motor M1 is compared with the number "P" of pulses stored in the bin counter at step S46. The stepping motor M1 continues rotating to move down the stapler 220 until the number "Pc" of pulses becomes equal to the number "P" stored in the bin counter (see step S64). When the number "Pc" of pulses becomes equal to the number "P" stored in the bin counter, the stepping motor M1 is stopped at step S62, and the moving flag is reset to "0" at step S63. Then, the processing returns to the main routine. Thus, the stapler 220 moves down to the position where it was when it was emptied of staples. Then the stapling is resumed.

Figure 17:
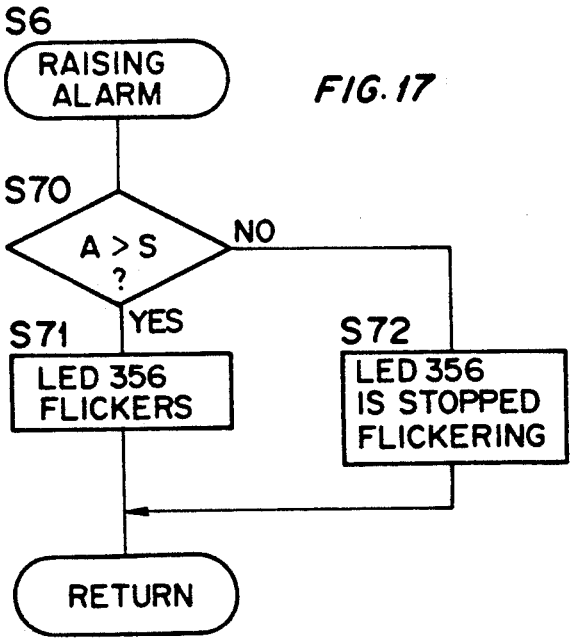

FIG. 17 shows the alarm raising subroutine carried out at step S6.

At step S70, a designated number "A" as the number of copy sets is compared with the count value "S" of the staple counter. The number "A" designated as the number of copy sets, which was entered into the copying machine 1 by an operator, is transmitted from the CPU 370 to the CPU 380. When the designated number "A" is larger than the count value "S" of the staple counter, the staple number indication LED 356 flickers at step S71 so as to warn the operator that the stapling will not be completed if the copying machine 1 is operated in the state and to recommend the operator to load more staples on the stapler 220. When the designated number "A" is not larger than the count value "S" of the staple counter, the LED 356 is stopped flickering.

Second Embodiment: FIGS. 18-23

An apparatus of a second embodiment comprises the same type of copying machine 1, RDH 30 and sorter 100 as shown in FIGS. 1 through 9. The RDH 30 and the sorter 100 of the second embodiment is different from those of the first embodiment in the following points.

The RDH 30 of the second embodiment also functions as a counter of original documents. Specifically, before copying, the RDH 30 counts original documents placed on the tray 31 while the documents are circulated through the original supporting glass 29 once. The count number of original documents is used in stapling as described later.

The sorter 100 of the second embodiment adopts the reciprocation sorting method. In the sorting mode, distribution of copies of an original which is of an odd page number starts with the first (top) bin and proceeds downward, and distribution of copies of an original which is of an even page number starts with the lowermost of the bins which received copies of the former originals and proceeds upward to the top bin.

Further, the finisher unit 300 of the second embodiment is the same as that of the first embodiment both in constitution and operation.

When the sorting mode and the stapling mode are selected, first the RDH 30 circulates original documents so as to count them. When the number of the original documents is an odd number, distribution of copies of the last original will starts with the top bin and proceeds downward. Therefore the stapler 220 is set to the home position alongside the top bin, and the stapler 220 starts stapling immediately after the first copy of the last original is transported into the top bin. When the number of original documents is an even number, distribution of copies of the last original will start with the lowermost of the bins which received copies and proceeds to the top bin. Therefore the stapler 220 is moved to the lowermost bin beforehand, and the stapler 220 starts stapling immediately after the first copy of the last original is transported into the bin. The control of the stapler 220 is hereinafter described, referring to FIGS. 18 through 23.

Figure 18:
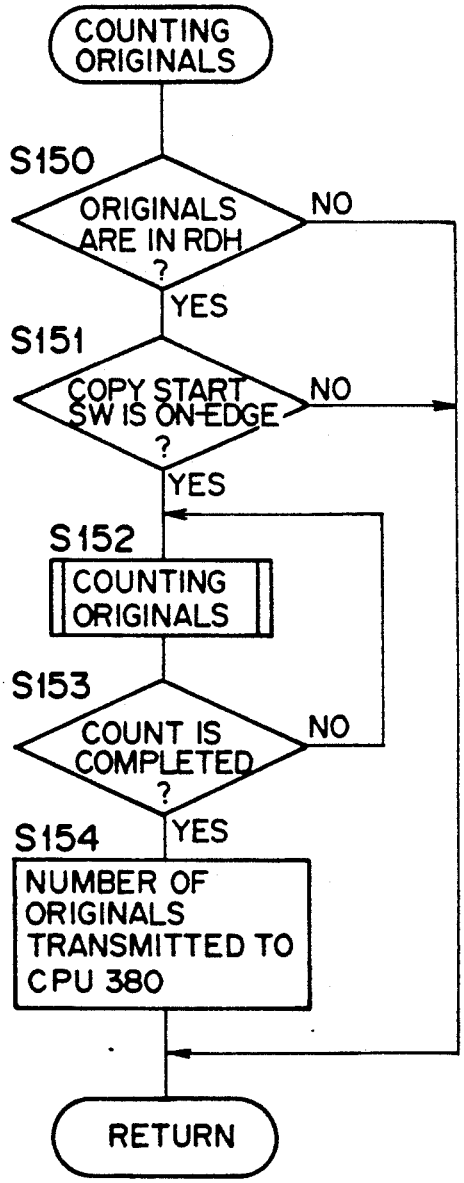
FIGS. 18 through 23 show a second exemplary image forming apparatus according to the present invention.

FIG. 18 shows a subroutine for counting original documents in the CPU 370. Since a main routine of the CPU 370 is well-known, the description is omitted.

Original documents are placed on the tray 31 of the RDH 30, and when a copy start switch on the operation panel (not shown) is turned on, count of the original documents is started. First, at step S150 presence of original documents on the tray 31 is judged with a sensor (not shown) provided in the tray 31, and the copy start switch is judged to be on-edge at step S151. Then, a subroutine for counting the original documents is carried out at step S152. The original documents are counted while the RDH 30 circulates the original documents once through the original supporting glass 29, the reversing path 35 and the ejection rollers 36. During the circulation, the copying machine CPU 370 counts the original documents, and the number is stored in a memory.

When it is judged at step S153 that the count of the original documents is completed, the number of the original documents is transmitted to the sorter CPU 380 at step S154.

Figure 19:
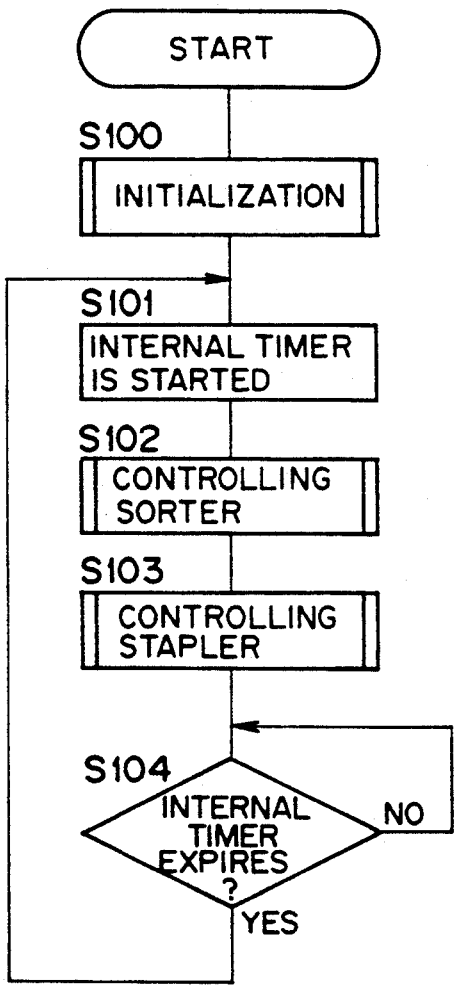

FIG. 19 shows a main routine of the sorter CPU 380.

When the CPU 380 is reset and the program is started, at step S100 the RAM is cleared and all the registers and devices are initialized. Next, an internal timer is started at step S101. The internal timer determines a time required for one cycle of the main routine, and the value is set at the initialization step S Next subroutines are called at steps S102 and 8103, and expiration of the internal timer is confirmed at step S104. Then, the processing returns to step S101. The values of timers in the subroutines depend on the time for one cycle of the main routine.

The subroutine called at step S102 is to control sheet distribution among the bins 102, and the description of the subroutine is omitted. The subroutine called at step S103 is to control sheet stapling with the stapler 220.

Figure 20:
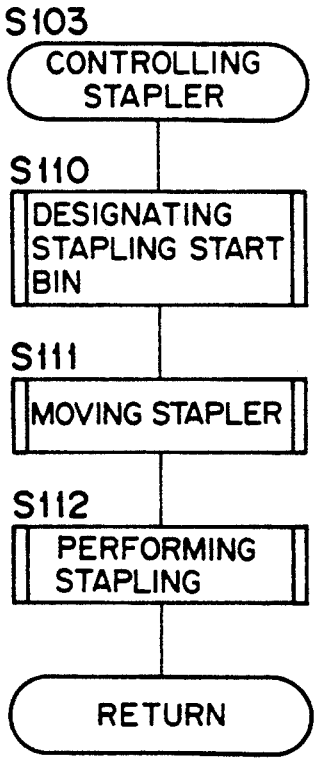

FIG. 20 shows the subroutine for controlling the stapler 220, which is carried out at step S103.

At step S110, one of the bins 102 is designated as a stapling start bin where the stapler 220 starts stapling, and the stapler 220 is moved to the stapling start bin at step S111. In this second embodiment, the sorter 100 adopts the reciprocation sorting method. When the number of original documents is an odd number, distribution of copies of the last original starts with the top bin and proceeds downward, and accordingly sheet stapling starts with the top bin. When the number of original documents is an even number, distribution of copies of the last original starts with the lowermost of the bins which received copies and proceeds upward, and accordingly sheet stapling starts with the lowermost bin. For this reason, the stapler 220 is moved to a bin in accordance with the number of original documents before stapling.

At step S112, the stapler 220 is moved from the stapling start bin step by step downward (when the number of original documents is an odd number) or upward (when the number of original documents is an even number) so as to staple the sheets stored in each of the bins 102. In the second embodiment, the pushing means 309 is moved together with the stapler 220.

Figure 21:
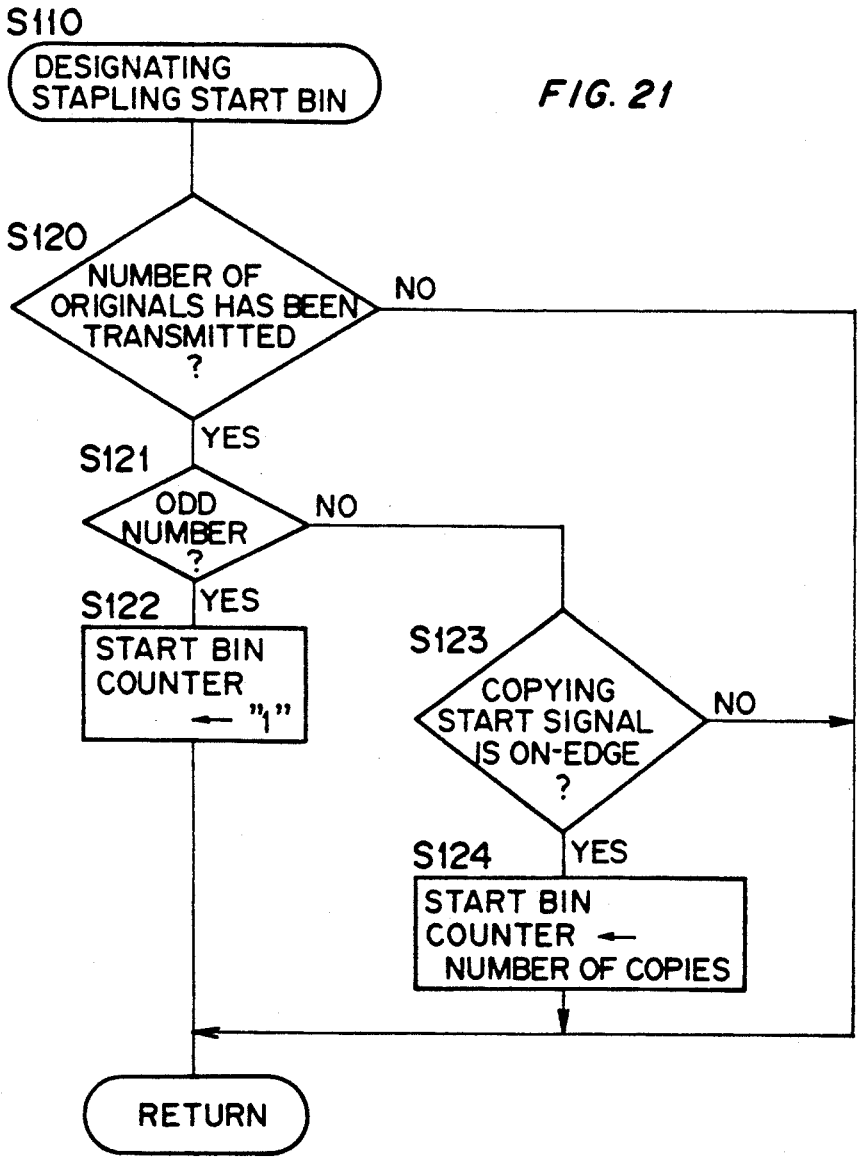

FIG. 21 shows the subroutine for designating the stapling start bin, which is carried out at step S110.

First, it is judged at step S120 whether data about the number of original documents has been transmitted to the CPU 380. The data transmission to the CPU 380 is performed at step S154 (see FIG. 18). When it is judged that the CPU 380 has received the data, the number of original documents is judged at step S121 whether to be an odd number or to be an even number. When the number is an odd number, at step S122 "1" is stored in a counter for indicating the stapling start bin, that is, the top bin 102 is designated as the stapling start bin. When the number is an even number, a copying start signal is judged whether to be on-edge at step S123. When the signal becomes on-edge, at step S124 the number of copies is stored in the start bin counter, that is, the bin 102 which is of a number from the top same as the number of copies is designated as the stapling start bin. Further, when the number of copies is larger than 20 (the number of the bins 102), "20" is stored in the start bin counter, that is, the bottom bin 102 is designated as the stapling start bin.

Figure 22:
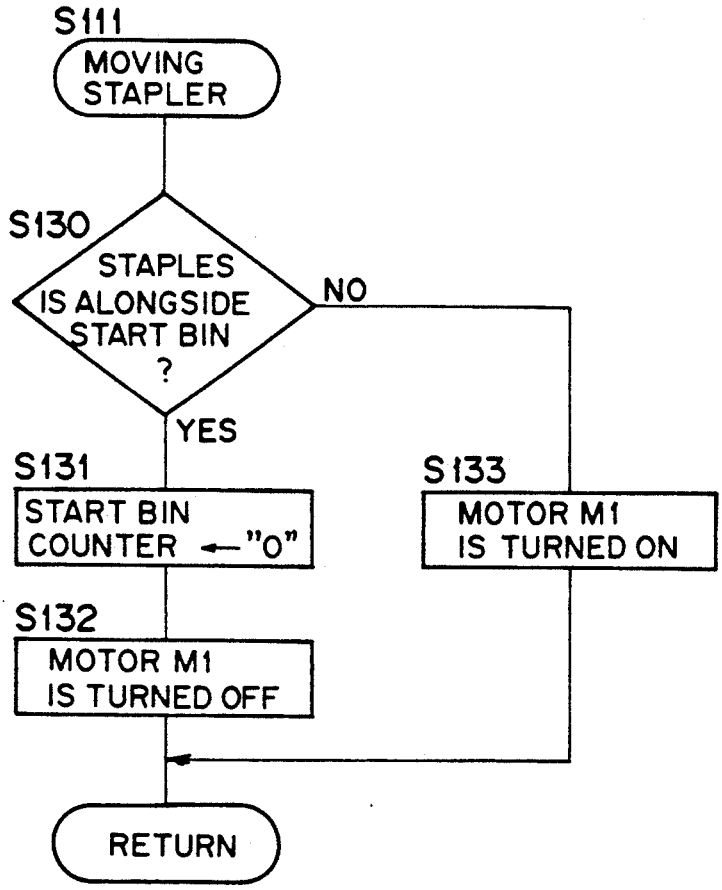

FIG. 22 shows the subroutine for moving the stapler 220 to the designated stapling start bin, which is carried out at step S111.

First, it is judged at step S130 whether the stapler 220 is alongside the designated stapling start bin. The position of the stapler 220 is recognized with the number of pulses driving the stepping motor M1. When the result at step S130 is "NO", the stepping motor M1 is turned on at step S133 so as to move up or down the stapler 220 toward the designated bin. When the stapler 220 reaches the designated bin ("YES" at step S130), the start bin counter is cleared at step S131. Simultaneously the stepping motor M1 is turned off at step S132 so as to stop the stapler 220, and this subroutine is completed.

Figure 23:
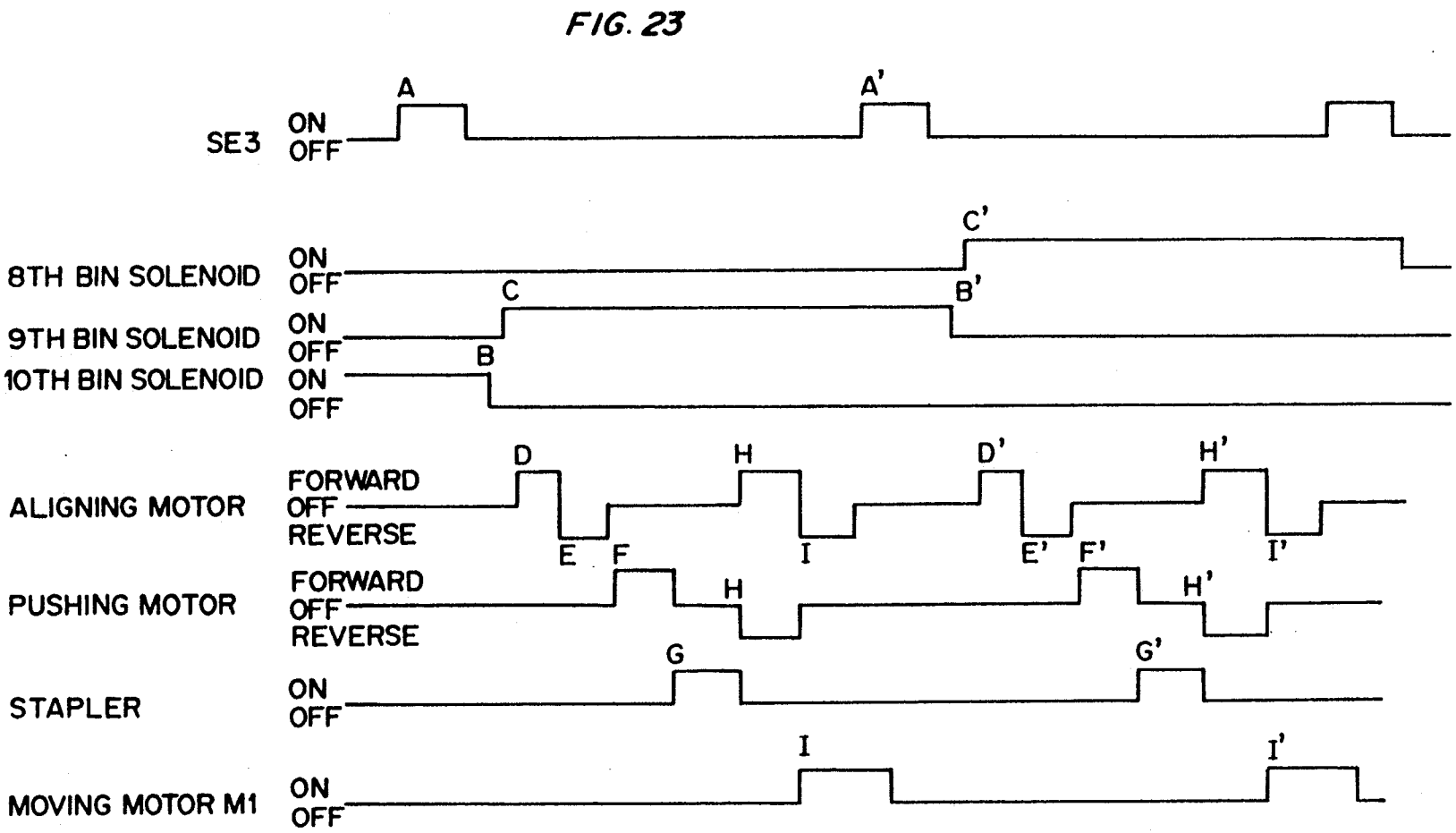

The start of the stapling (carried out at step S112) is hereinafter described, referring to a time chart in FIG. 23. When a first copy of the last original of those set in the RDH 30 is ejected from the copying machine 1 and transported into a specified one of the bins 102, the stapler 220 staples the sheets stored in the bin 102. Then, a second copy of the last original is transported into a next bin 102. The time chart shows a case where the number of copy sets is "10" and where the number of originals is an even number. The stapler 220 is already alongside the stapling start bin, the tenth bin 102.

When a first copy of the last original is transported into the tenth bin 102 (timing A), a solenoid of the tenth bin 102 is turned off (timing B). Subsequently, a solenoid of the ninth bin 102 is turned on (timing C) for a preparation of receiving a next coming copy. Next, the sheet aligning motor is rotated forward with a slight lag from the time when the tenth bin 102 receives the copy (timing D) so that the copy is pushed against the alignment reference plate 102*b*. Thereafter the sheet alignment motor is reversed (timing E) so that the aligning means 308 retreats from the copy. Thereby, the copy transported into the tenth bin 102 comes into alignment with the sheets already stored in the tenth bin 102. Next, the sheet pushing motor is rotated forward (timing F) so that all the sheets in the tenth bin 102 are pushed against the reference plate 102*c*. In the situation where the sheets are set at the stapling position P3, the stapler 220 is turned on (timing G) so as to staple the sheets. After the stapling of the sheets, the sheet pushing motor and the sheet aligning motor are rotated in reverse and forward respectively (timing H) so as to push the stapled sheets back to the alignment position P2. Then, the stapler moving motor M1 is turned on (timing I) so as to move the stapler 220 and the pushing means 309 to the ninth bin 102. Simultaneously the sheet aligning motor is reversed so that the aligning means 308 retreats from the stapled sheets.

When the next copy, that is, the second copy of the last original is transported into the ninth bin 102 (timing A'), the operation described above is performed at timings B' through I'. The operation is repeated until the first (top) bin 102 is subjected to the sheet stapling.

As described above, in the second embodiment, immediately after the first copy of the last original is transported into a specified one of the bins 102, the stapling starts. Then, the stapling proceeds as the rest of the copies of the last original are distributed to other bins 102. This increases the speed of copying including sorting and stapling.

Other Embodiments

Although the present invention has been described in connection with the embodiments above, it is to be noted that various changes and modifications are apparent to those who are skilled in the art. Such changes and modifications are to be understood as included in the appended claims.

For example, in order to recognize the position of the stapler 220, a sensor for detecting the stapler 220 can be provided in each of the bins 102 instead of counting pulses driving the stepping motor M1. If the case 310 is so made that the cover 31 can open widely enough to expose the whole stapler 220, cartridge changes and maintenance will be easier. Also the staple loading position is not limited to the top of the case 310, and any position convenient for staple loading and maintenance can be selected as the staple loading position in accordance with the structure of the case 310 and the parts therearound.

Regarding a cartridge change and resetting the indication of the number of staples on the indicator 365, a reset switch can be provided on the operation panel so that the indication of the indicator 365 changes to an initial number by operating the reset switch at the time of a cartridge change, or a ten-key can be provided on the operation panel 350 so as to indicate any number on the indicator 365.

Various modifications of the sorter and the finisher unit are available. Regarding sheet distributing means, it is possible to provide a distribution unit which comprises a transport tape and a retractable tape and which is movable up and down along the entrances of the bins 102 instead of the diverting pawls 120. It is not always required to divide the bins 102 into two sections. Also, arrangement of the bins 102 is not limited to that where laterally postured bins are arranged one upon another, and it is possible to arrange vertically postured bins side by side.

It is possible to adopt a method of stapling sheets on a stapling tray in the first embodiment. In the method, sheets stored in each bins are automatically taken out thereof and transported to the stapling tray where the sheets are stapled. Also, as long as the copying apparatus is provided with the RDH 30 and a stacker where stapled copy sets are stored, only one bin or tray is required. Each time originals set in the RDH 30 are circulated once, copies of the originals are stapled in the bin or the tray, and the stapled copy set is ejected in the stacker.

Regarding the indication of the number of staples on the indicator 365, it may be good that the initial number set in the staple counter and indicated on the indicator 365 is "4,970" even if a new cartridge contains 5,000 staples. This is because poor stapling often occurs when a small number of staples remain in the cartridge 227. Also, it is not necessary to indicate the number of staples in the cartridge 227 from the beginning, and the indication can be started when the number of staples remaining in the cartridge 227 becomes a certain number, as an example, "99". Further, it is not necessary to indicate the number of staples in the cartridge 227, and what is at least required is to inform an operator with an indication that the number of staples remaining in the cartridge 227 is less than a specified number.

What is claimed is:

1. An image forming apparatus comprising
means for forming an image on a sheet;
means for distributing sheets which have received images among a plurality of bins;
means for binding the sheets distributed to each of the bins, the binding means containing a number of binding elements;
means for moving the binding means along the bins;
means for detecting the binding elements in the binding means; and
control means for, when the binding element detecting means detects no binding elements, moving the binding means to a position where the binding means is loaded with binding elements.

2. An image forming apparatus as claimed in claim 1, further comprising;
memory means for memorizing which bin the binding means faces when the detecting means detects no binding elements; and
means for detecting completion of loading of the binding means with binding elements;
wherein, when the loading detecting means detects the completion of loading, the control means moves the biding means to the bin memorized by the memory means.

3. An image forming apparatus as claimed in claim 1, further comprising means for, when the binding element detecting means detects no binding elements, indicating that the binding means has been emptied of binding elements.

4. An image forming apparatus comprising:
means for forming an image on a sheet;
means for distributing sheets which have received images among a plurality of bins;
means for binding the sheets distributed to each of the bins, the binding means containing a number of binding elements;
means for moving the binding means from a home position along the bins;
means for detecting the binding elements in the binding means; and
control means for, when the binding element detecting means detects no biding elements, moving the binding mans to the home position.

5. An image forming apparatus as claimed in claim 4, further comprising:
memory means for memorizing which bin the biding means faces when the binding element detecting means detects n binding elements; and
means for detecting completion of loading of the binding means with binding elements;
wherein, when the loading detecting means detects the completion of loading, the control means moves the binding means to the bin memorized by the memory means.

6. An image forming apparatus as claimed in claim 4, further comprising means for, when the binding elements detecting means detects no biding elements, indicating that the binding means has been emptied of binding elements.

7. An image forming apparatus comprising:
means for forming an image on a sheet;
means for distributing sheets which have received images among a plurality of bins;
means for binding the sheets distributed to each of the bins;
a cartridge containing a number of binding elements, the cartridge being mounted on and dismounted from the binding means;
means for moving the binding means along the bins;
means for detecting the binding elements in the cartridge; and
control means for, when the binding element detecting means detects no binding elements, moving the binding means to a position where the cartridge is mounted on and dismounted from the binding means.

8. An image forming apparatus as claimed in claim 7, wherein the position where the cartridge is mounted on and dismounted from the binding means is a home position of the binding means.

9. An image forming apparatus comprising:
means for forming an image on a sheet;
means for stacking sheets which have received images;
means for binding the sheets stacked in the stacking means, the binding means containing a number of binding elements;
means for counting the binding elements in the binding means; and
means for indicating the number of the binding elements counted by the counting means.

10. An image forming apparatus as claimed in claim 9, wherein the binding means initially contains a specified number of binding elements.

11. An image forming apparatus as claimed in claim 9, wherein the indicating means newly indicates a number decreased by one each time the binding means consumes one binding element to bind a set of sheets.

12. An image forming apparatus comprising:
means for forming an image on a sheet;
means for designating the number of imaged-sheet sets to be made by the image forming means;
means for stacking sheets which have received images;
means for binding the sheets stacked in the stacking means, the binding means containing a number of binding elements;
means for counting the binding elements in the binding means;
means for comparing the number of imaged-sheet sets designated by the designating means with the number of binding elements counted by the counting means; and
means for, when the comparing means judges that the designated number of imaged-sheet sets is larger than the number of binding elements, giving an indication.

13. An image forming apparatus as claimed in claim 12, wherein the binding means has a removable cartridge which initially contains a specified number of binding elements.

14. An image forming apparatus comprising
means for feeding originals to an exposure position one by one;
means for counting the originals fed by the original feeding means;
means for making copies of the originals fed to the exposure position by the original feeding means;
means for distributing the copies among a plurality of bins;

means for biding the copies distributed to each of the bins;

means or moving the binding means along the bins; and control means for designating one of the bins as a binding start bin which is first subjected to sheet binding in accordance with the number of originals counted by the counting means, and for moving the binding means to the designated bin.

15. An image forming apparatus as claimed in claim 14, wherein, when the number of the originals is an odd number, the control means designates a first bin which is to receive a first made copy of a first fed original as the binding start bin and moves the binding means to the first bin, and when the number of the originals is an even number, the control means designates a bin which is to receive a last made copy of the first fed original as the binding start bin and moves the binding means to the bin.

16. An image forming apparatus as claimed in claim 15, wherein the bins are laterally postured and arranged one upon another, and the first bin is the topmost bin.

17. An image forming apparatus as claimed in claim 14, further comprising means for selecting a binding mode where the binding means binds the copies distributed to each of the bins, wherein the counting means counts the originals when the binding mode is selected.

18. An image forming apparatus comprising:

means for feeding originals to an exposure position one by one;

means for making copies of the originals fed to the exposure position by the original feeding means;

means for distributing the copies among a plurality of bins;

means for detecting which bin a first made copy of a last fed original is to be distributed to;

means for binding the copies distributed to each of the bins;

means for moving the binding means along the bins and for stopping the binding means at a specified position; and control means for moving the binding means to the bin detected by the detecting means before a last made copy of the last fed original is distributed to one of the bins.

19. An image forming apparatus as claimed in claim 18, further comprising means for selecting a binding mode where the binding means binds the copies distributed to each of the bins, wherein when the binding means is selected, the detecting means is operated and the binding means is moved in accordance with output of the detecting means.

* * * * *